US006600402B1

(12) United States Patent
LaFleur et al.

(10) Patent No.: US 6,600,402 B1
(45) Date of Patent: Jul. 29, 2003

(54) BOBBINS, TRANSFORMERS, MAGNETIC COMPONENTS, AND METHODS

(75) Inventors: Michael B. LaFleur, East Hampstead, NH (US); Patrizio Vinciarelli, Boston, MA (US)

(73) Assignee: VLT Corporation, San Antonio, TX (US)

( * ) Notice: Subject to any disclaimer, the term of this patent is extended or adjusted under 35 U.S.C. 154(b) by 0 days.

(21) Appl. No.: 09/184,461

(22) Filed: Oct. 20, 1998

(51) Int. Cl.[7] ..... H01F 27/08

(52) U.S. Cl. ..... 336/61; 336/84 R; 336/198; 336/212; 336/219

(58) Field of Search ..... 336/55, 61, 182, 336/184, 194, 220, 87, 65, 178, 208, 192, 84 R, 84 M, 84 C, 198, 212, 219

(56) References Cited

U.S. PATENT DOCUMENTS

| | | | | |
|---|---|---|---|---|
| 4,441,146 A | | 4/1984 | Vinciarelli | 363/20 |
| 4,507,975 A | * | 4/1985 | Bittner et al. | 73/861.12 |
| 5,420,559 A | * | 5/1995 | Ohshiba et al. | 336/208 |
| 5,719,544 A | | 2/1998 | Vinciarelli et al. | 336/84 |
| 5,959,521 A | | 9/1999 | Kohmura et al. | |
| 6,092,557 A | * | 7/2000 | Sumner | 138/149 |

FOREIGN PATENT DOCUMENTS

| | | | |
|---|---|---|---|
| JP | 5-205953 | 8/1993 | H01F/31/06 |

OTHER PUBLICATIONS

Andrus et al., "Plating Permeable Cores", U.S. Ser. No. 08/941,219, filed Oct. 1, 1997.

* cited by examiner

*Primary Examiner*—Tuyen T. Nguyen
(74) *Attorney, Agent, or Firm*—Fish & Richardson P.C.

(57) ABSTRACT

A bobbin is adapted to support a winding on a permeable core and has a wall that provides a confined thermally conductive channel that causes conduction of heat along a predetermined path from the core to a location outside the winding. A value of magnetizing inductance in a transformer is set by adjusting the gap until the value of magnetizing inductance has been set and attaching a segment of the bobbin to a pair of core pieces to maintain the gap. A permeable slug provides a permeable path outside of the hollow interior space and does not couple the winding, and an electrically insulating coupler is interposed between the slug and the winding to electrically insulate the winding.

74 Claims, 14 Drawing Sheets

BOBBINS, TRANSFORMERS, MAGNETIC COMPONENTS, AND METHODS

BACKGROUND OF THE INVENTION

This invention relates to bobbins, transformers, magnetic components, and methods.

FIGS. 1A and 1B show, respectively, a top and side view of a transformer 10 of the kind described in U.S. Pat. No. 5,719,544 ("Transformer With Controlled Interwinding Coupling and Controlled Leakage Inductances and Circuit Using Such Transformer," Vinciarelli et al., assigned to the same assignee as this application and incorporated herein by reference, the "transformer patent"). The transformer comprises two bobbin assemblies 1A, 1B, each comprising an electrically conductive winding 2A, 2B wound over a non-conductive bobbin 4A, 4B. The two windings are linked by a magnetic medium comprising two core assemblies 11. Each core assembly comprises an electrically conductive medium 12 selectively arranged over the surface of a permeable core piece 6 (e.g., by means of plating—see, for example, U.S. patent application Ser. No. 08/941,219 filed on Oct. 1, 1997—or use of formed sheets or foils). The faces 8 of the core pieces 6 are free of conductive medium and a slit is provided along the inner periphery of the core assemblies (not shown), thereby preventing formation of a "shorted turn." The conductive medium 12 constrains the transformer leakage flux to lie within the region confined by the conductive medium. As discussed in the transformer patent, such a transformer has a number of benefits: it exhibits much lower leakage inductance than similar transformers without a conductive medium; the widely separated windings exhibit low interwinding capacitances; the placement of the windings provides for easy removal of heat; and many different transformers, varying in terms of turns ratio and leakage inductance, may be constructed from relatively few common parts (e.g., bobbins, core pieces). The magnetizing inductance of the transformer may be set by means of a gap 16 in the magnetic path (a portion of the bobbin 4B and winding 2B are shown cut away to show the gap).

In other transformer embodiments, described in the transformer patent and shown in FIG. 2, extensions 20 of the permeable magnetic material may be used to provide a low reluctance path for leakage flux 21 in the region between the core halves, thereby providing a greater possible range of leakage inductance. Such extensions 20 may also be covered with a conductive medium.

As shown in FIG. 3, a saturable inductor 22 is sometimes placed in series with a winding 26 of a transformer 24 in a switching power supply. In some applications, the saturable inductor is used to limit rectifier 32, 33 reverse recovery currents and attendant conducted and radiated noise. Such an inductor may also be used in a converter comprising an "active clamp" core resetting circuit 30 (of the kind described in U.S. Pat. No. 4,441,146, "Optimal Resetting of the Transformer's Core in Single-Ended Forward Converter, Vinciarelli, assigned to the same assignee as this application, incorporated by reference) to provide a high impedance load on the transformer winding for a short time following turn-on of the main switch 28, thereby allowing the "mirrored" flow of transformer magnetizing current to more fully charge and discharge parasitic capacitances than would otherwise be possible without it and allow for zero-voltage switching operation. The number of turns on the saturable inductor 22 will depend on the required "volt-second" rating and will, for a given transformer configuration, vary as a function of the output voltage of the converter. To maintain a fixed "time to saturation", the number of turns on a saturable inductor will, for a given saturable core, need to increase in proportion to transformer output voltage. Thus, different saturable inductors are generally required for different output voltage settings.

SUMMARY OF THE INVENTION

In general, in one aspect, the invention features a bobbin adapted to support a winding on a permeable core and having a wall that provides a confined thermally conductive channel that causes conduction of heat along a predetermined path from the core to a location outside the winding.

Implementations of the invention may include one or more of the following features. The bobbin may have an electrically insulating wall surrounding a hollow interior space, the electrically insulating wall including segments having different thermal conductivities to provide the confined thermally conductive channel. The confined thermally conductive channel may be provided by ceramic (e.g., alumina). One of the segments may be plastic. A solderable metal coating of the bobbin may provide the confined thermally conductive channel and may be attached to the permeable core. The confined thermally conductive channel may have a thermal conductivity greater than 1 BTU/(hourxfootxdeg.F) while another segment of the bobbin may have a thermal conductivity less than 1 BTU/(hourxfootxdeg.F)).

In general, in another aspect, the invention features a magnetic component that includes the bobbin and a permeable core.

Implementations of the invention may include one or more of the following features. The permeable core may include separable core pieces that define a magnetic path. The ends of core pieces may be separated by a gap. The core pieces may include a conductive medium on portions of their surfaces. One of the segments may be attached (e.g., by epoxy or solder) to the core pieces and may set the gap. The conductive medium may be copper.

In general, in another aspect, the invention features a leakage inductance transformer that includes the bobbin, a winding surrounding the bobbin, and a permeable magnetic core having a magnetically permeable segment which passes within the bobbin to form a flux path that couples the winding.

Implementations of the invention may include one or more of the following features. A magnetically permeable leakage lug and a permeable magnetic slug may be located outside of a hollow interior space enclosed by the bobbin. The slug may lie in a flux path defined by, and be permeably linked to, the leakage lug. The slug may be a saturable magnetic material.

In general, in another aspect, the invention features a method of setting a value of magnetizing inductance in a transformer comprising a winding bobbin having segments one of which is more thermally conductive and core pieces having ends that are separated by a gap. The method includes adjusting the gap until the value of magnetizing inductance has been set, and attaching a segment of bobbin to the core pieces to maintain the gap.

Implementations of the invention may include one or more of the following features. The adjusting may include moving one core piece to adjust the gap while measuring the magnetizing inductance and stopping the movement when the measurement of magnetizing inductance is essentially equal to the pre-determined value. The attaching may include providing a bonding medium in the region between the surfaces of the core pieces and processing the bonding medium to cause it to set. The bonding medium may include thermally setting epoxy, or solder. The processing may include heating the bonding medium by passing a magnetic field through the gap.

In general, in another aspect, the invention features a transformer structure that includes a bobbin that defines a hollow interior space and has an outer surface configured to carry a winding, a permeable core that lies within the interior space in a position to couple the winding, a permeable slug that provides a permeable path outside of the hollow interior space and does not couple the winding, and an electrically insulating coupler interposed between the slug and the winding to electrically insulate the winding.

Other advantages and features will become apparent from the following description and from the claims.

BRIEF DESCRIPTION OF THE DRAWINGS

Among the benefits provided by the transformer structure 10 of FIGS. 1 and 2 are reduced interwinding capacitances and ease of removal of heat from the windings owing to the placement of the windings on the exterior of the structure. However, a drawback of the structure is that the bobbins 4A, 4B, which provide electrical insulation between the windings and the cores and which are typically fabricated from materials which exhibit low electrical and thermal conductivity (e.g., plastic), cover portions of the surface area of the core assemblies 11, thereby interfering with removal of heat from the cores assemblies themselves. As shown in FIG. 4, one way to aid in the removal of heat from the core of a transformer having thermally insulating bobbins is to fasten thermally conductive "core coolers" 15 to the ends of the core assemblies 11. Heat generated in the cores is conducted by the core coolers to a heat sinking surface 34. In one example, the core coolers are fabricated from copper and are soldered to both the conductive shields (12, FIG. 1) and to a heat sink 34.

Figure 5:
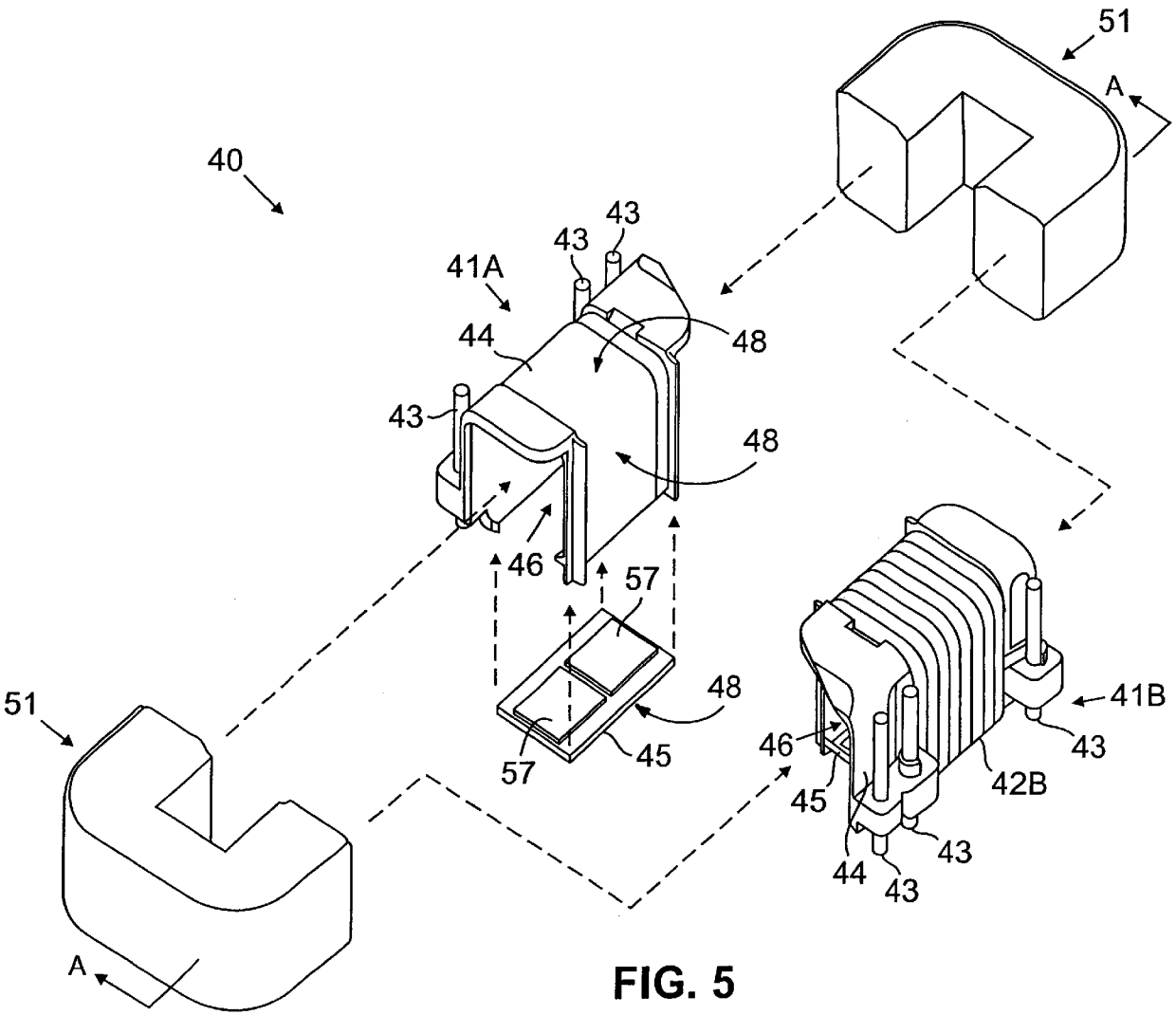
FIG. 5 shows a transformer with composite bobbins.

In the example shown in FIG. 5, the transformer 40 comprises two core assemblies 51 and two composite bobbin assemblies 41A, 41B. Each of the composite bobbin assemblies comprise a formed segment 44, a winding (only one such winding 42B is shown) and a thermally conductive segment 45. In one example, the formed segment is molded from electrically non-conductive plastic and the thermally conductive segment is made from a 0.26"×0.575"×0.020" flat piece of alumina ceramic, which is thermally conductive but electrically non-conductive. As shown in the Figure, the thermally conductive segment is attached to the formed segment to create a hollow composite bobbin assembly 41A, 41B around which a winding 42B can be wound. Conductive pins 43 are provided for terminating windings and for connecting the windings to external circuitry.

The transformer 40 is assembled by first selecting composite bobbins having desired numbers of turns and a pair of core assemblies 51. As shown in the sectioned side view of FIG. 6 (section A—A, FIG. 5), the core assemblies 51 are inserted into the open ends (e.g., open ends 46, FIG. 5) of the hollow composite bobbin assemblies 41A, 41B and attached to the surface of the thermally conductive segments 45 using a bonding medium 49. The bonding medium 49 can be epoxy. The bonding medium is preferably a material which is flexible when applied and which requires a processing step, such as heating, to form a bond. This provides for relatively rapid formation of the bond once assembly is complete, while eliminating the problem of having the bond form during assembly. Thermally setting epoxies and solder paste are examples of such bonding mediums. Solder can be used as the bonding medium if the core assemblies comprise a conductive shield at least in the region which is adjacent to the thermally conductive segment and if solderable pads (57, FIG. 5) are provided on the surface of the thermally conductive segment 45 (e.g. 0.5 milli-inch thick pads of palladium silver copper pads 57 deposited on the surface of a piece of alumina ceramic). This is shown in cross-section in FIG. 7, in which solder 49 connects solderable pads 57 to the conductive coatings 12 on core pieces 6.

Figure 4:
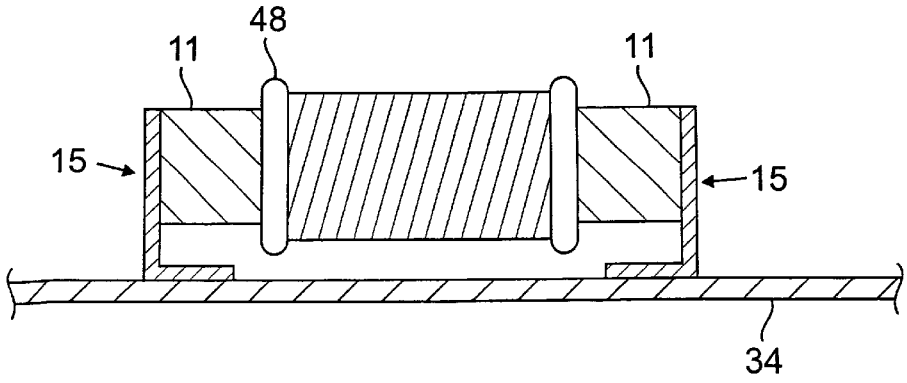
FIG. 4 shows a transformer connected to a heat sink by means of core coolers.
Figure 6:
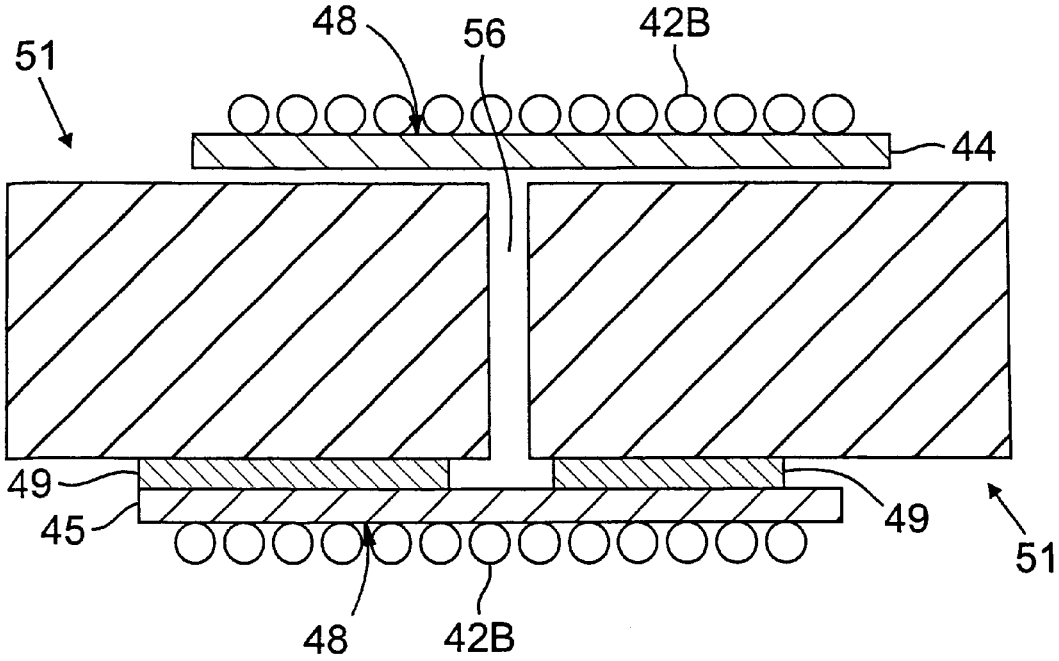
FIG. 6 shows a sectioned view of a transformer.
Figure 7:
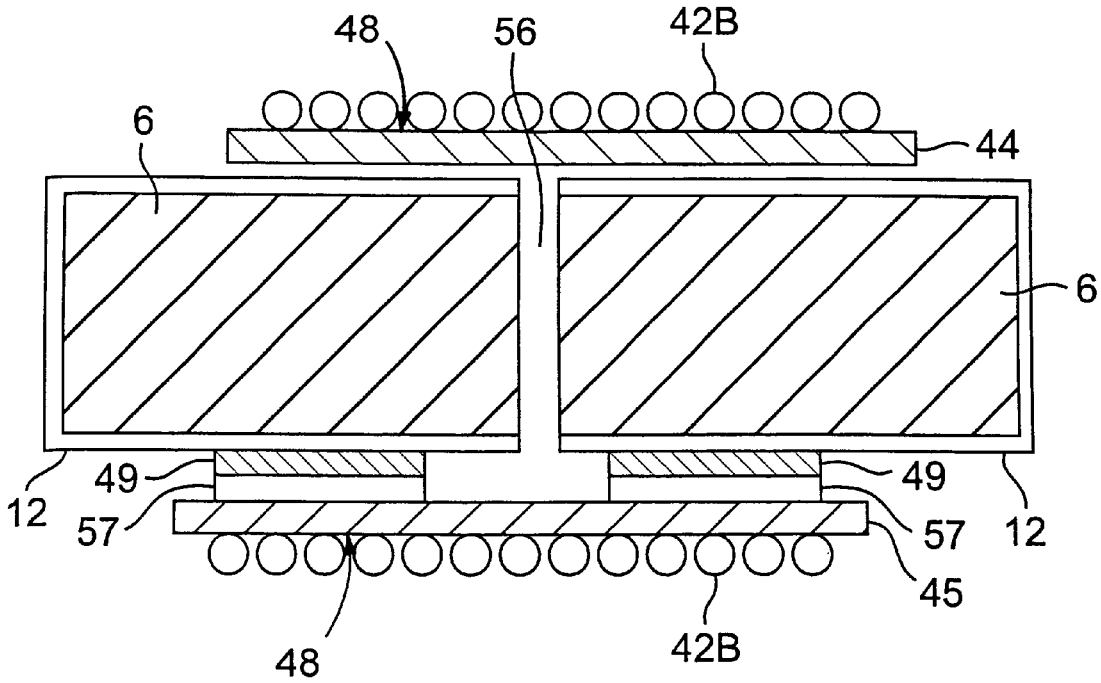
FIG. 7 shows a sectioned view of a transformer.
Figure 8:
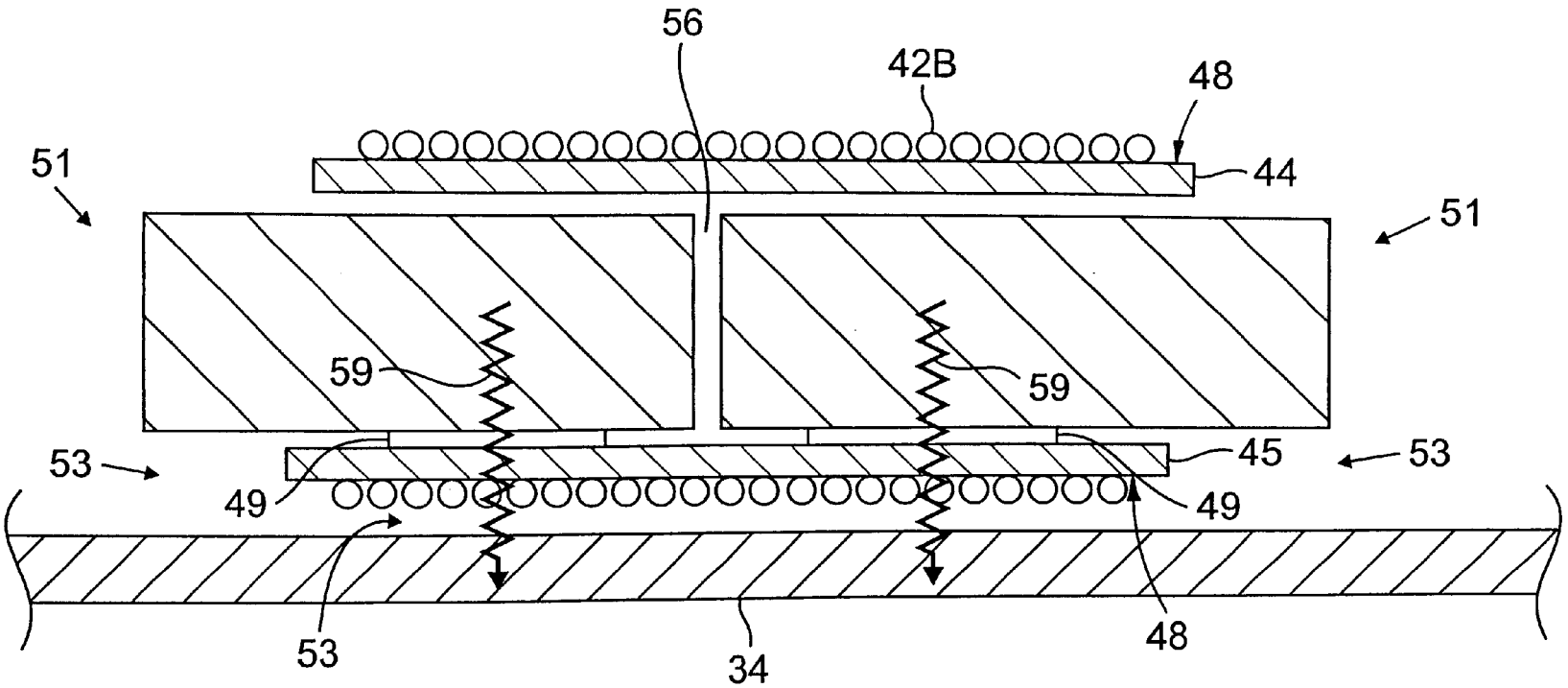
FIG. 8 shows a transformer in proximity to a heat sinking surface.

As shown in FIG. 8, when a transformer of the kind shown in FIGS. 5–8 is placed in proximity to a heat sinking surface 34 (a thermally conductive encapsulating material is presumed to fill the regions 53 between the transformer and the heat sink 34), the material in the bobbin does not create a high impedance thermal path between the core pieces 51 and the heat sink. Rather, the bonding medium 49 and the thermally conductive segment 45 form relatively low thermal impedance paths 59 between the core assemblies 51 and the heat sink 34. This allows for cooler operation of the cores whether or not core coolers (15, FIG. 4) are used. Solder is a preferred bonding medium 49 because of its high thermal conductivity and its ability to fill relatively thick gaps (e.g., 10 milli-inches) between the thermally conductive segment 45 and the core assembly 51. By using solderable pads 57 (FIGS. 5, 7) having relatively large surface areas, relatively low values of thermal impedance can be achieved.

The non-conductive wall 48 (FIG. 5) of the bobbin has a segment 44 having a relatively low thermal conductivity and a segment 45 having a relatively high thermal conductivity. As used herein, the term "low thermal conductivity" will mean materials having a thermal conductivity less than 1 BTU/(HourxFootxdeg.F) and the term "high thermal conductivity" will mean materials having a thermal conductivity greater than or equal to 1 BTU/(HourxFootxdeg.F). For example, in some embodiments the formed segment 44 is molded from a PPS or LCP plastic, such as Vectra™ or Ryton™, which exhibit low thermal conductivities in the range of 0.12 to 0.17 BTU/(HourxFootxdeg.F), and the thermally , conductive segment 45 is made of Alumina ceramic having a high thermal conductivity ranging from 8 to 12 BTU/(HourxFootxdeg.F).

Because the bonding medium forms a permanent bond between the core assemblies and the thermally conductive segment, the assemblies of FIGS. 5–7 provide an inherent means for accurately and permanently setting a gap 56 in the magnetic path (for setting, for example, a pre-determined value of magnetizing inductance). To accurately set the magnetizing inductance, the inductance of a transformer winding (e.g., winding 42B, FIG. 5) is measured while the gap 56 between the core assemblies 51 is adjusted. When the positioning of the core assemblies results in a pre-determined value of magnetizing inductance, insertion of the core assemblies is stopped. The bonding medium 49, which was placed on the surface of the thermally conductive segments 45 prior to insertion of the core assemblies, is then processed to create a bond. For example, if solder paste were used for the bonding medium, heat would be applied to the core pieces to melt the paste, which, upon cooling, would create a rigid solder bond between the core assemblies and the thermally conductive segment. A heat activated thermally conductive epoxy could be used in the same way.

Figure 9:
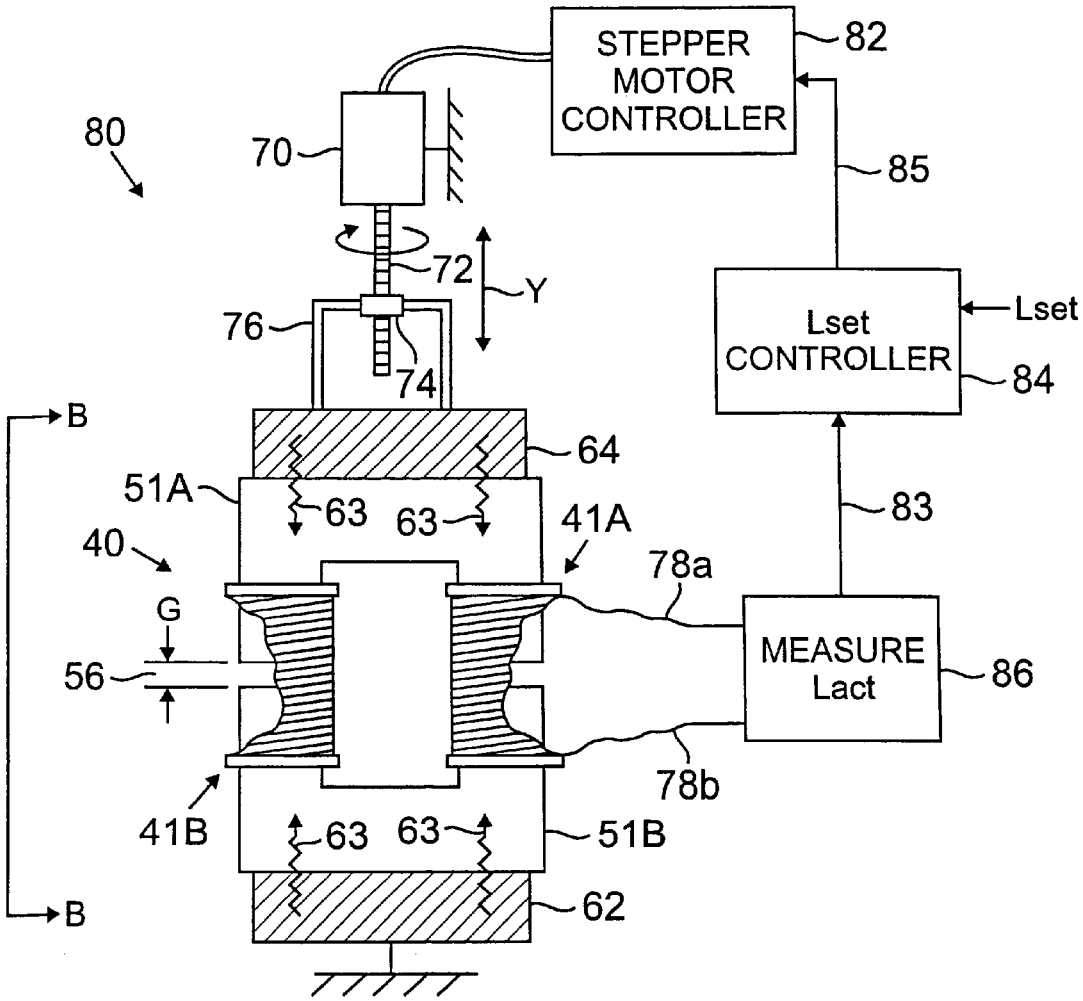
FIG. 9 shows apparatus for setting the magnetizing inductance of a transformer.

A system for accurately setting the gap is shown in FIG. 9. In the Figure a transformer 40 is held between two stops 62, 64. A first fixed stop 62 holds first core assembly 51B (e.g., by means of a vacuum, not shown); a second moveable stop 64 holds second core assembly 51A. The relative position of the first and second stops is adjusted by means of stepper motor 70. Rotation of the stepper motor shaft 72 is translated into linear motion of stop 64 (as indicated by the arrow marked "Y") by means of rollnut 74 and bracket 76. In operation a desired value of magnetizing inductance, Lset, is delivered to the Lset controller 84. Measurement device 86 delivers an actual value 83 of magnetizing inductance, Lact, to the Lset controller 84. The Lset controller compares the Lact to Lset, and, based on the difference, delivers information regarding motor speed and direction of rotation 85 to the stepper motor controller 82. If Lact is less than Lset, the motor will be driven in a rotational direction which decreases the gap 56. Should the gap be adjusted too far, causing Lact to be greater than Lset, the motor direction will be reversed and the gap increased. The motor can be operated at a fixed speed, or, to reduce setting time, motor speed may be decreased as Lact approaches Lset.

Once the gap 56 has been set to its final value, heat is applied to set the bonding medium, as described above (the thermally conductive segment and the bonding medium are not shown in FIG. 9). One way to apply heat, shown in FIG. 9, is to incorporate heating elements into the stops 62, 64. Heat is conducted from the heaters into the core assemblies and down into the region of the gap, as indicated by the arrows 63. If thermally setting epoxy is used as a bonding medium, the heat will cause the epoxy to set. If solder paste is used as bonding medium, and sufficient heat is applied for a sufficient period of time, the solder paste will melt, after which the heaters are turned off. The solder will harden on cooling. In either case the setting of the gap 56 will be permanently fixed by the bonding medium.

Figure 10A:
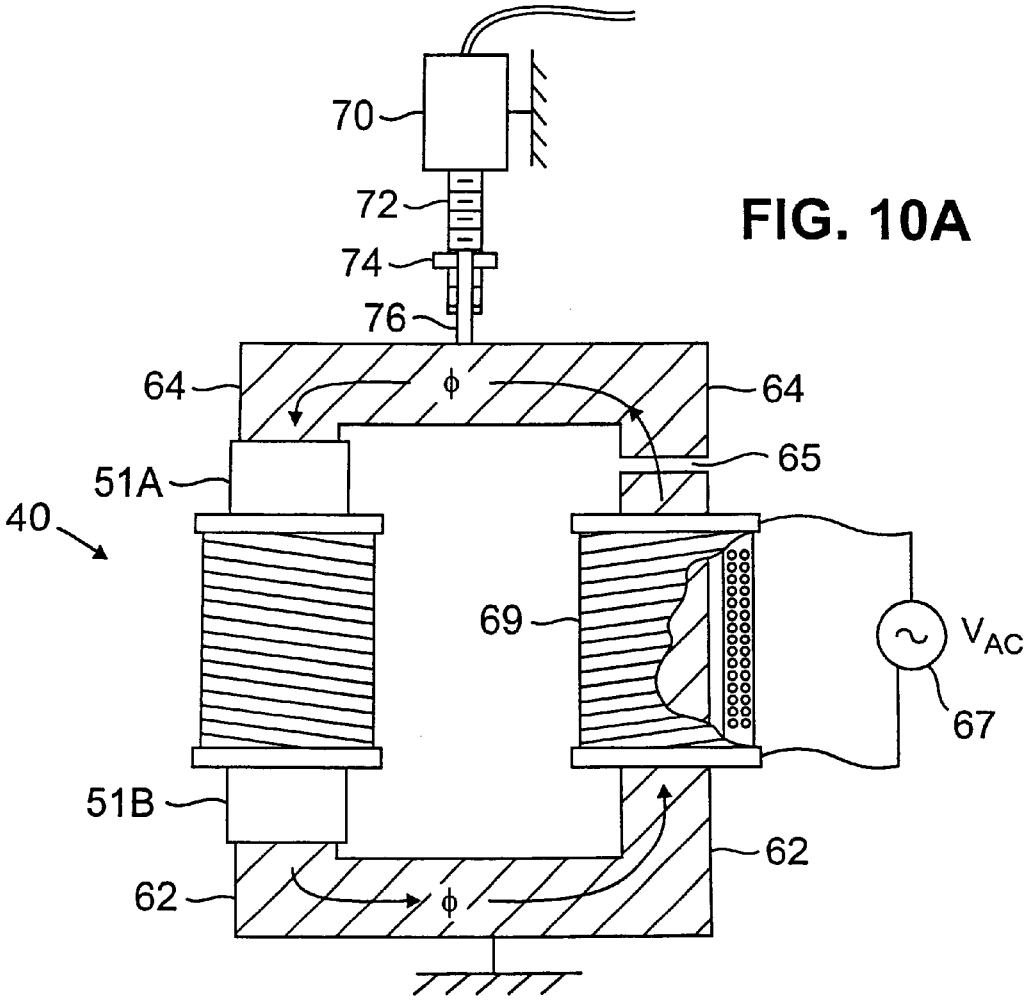
FIGS. 10A and 10B show apparatus for generating heat in a gapped magnetic structure.
Figure 10B:
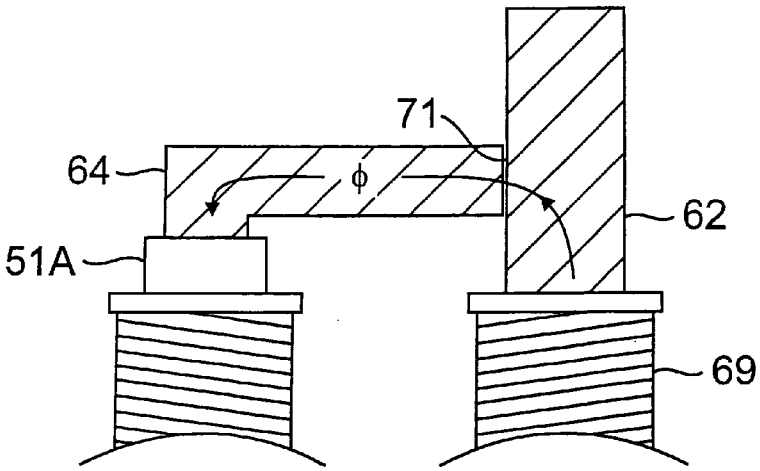

One way to provide heat in the region of the gap is shown in FIG. 10A, which shows a side view (view B—B, FIG. 9) of a portion of the apparatus of FIG. 9. In the Figures the stops 62, 64 are magnetically permeable elements which are part of a closed magnetic path which also comprises the core assemblies 51A, 51B, the gap 56 (FIG. 9) between the core faces, and a second gap 65. A winding 69, surrounding a portion of stop 62, is driven by an AC voltage source to induce an AC flux, $\phi$, in the magnetic path. Because the gaps represent high reluctance regions in the closed magnetic path, the AC flux causes selective heating in these regions. The second gap 65 provides for motion of stop 64 relative to stop 62. An alternative construction, shown in FIG. 10B, minimizes the effect of the variable second gap 65 by providing a region 71 in which an extension of stop 62 is in contact with, but not rigidly connected to, stop 64. This provides for motion of stop 64 relative to stop 62 while minimizing the non-variable gap in region 71.

Figure 2:
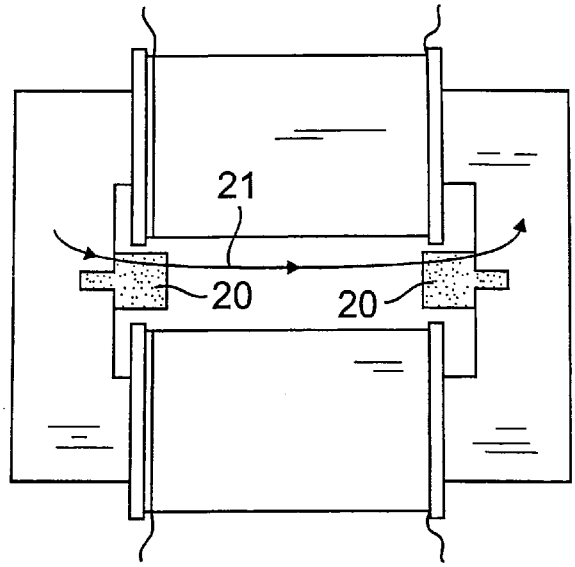
FIG. 2 shows a top view of a transformer.
Figure 11A:
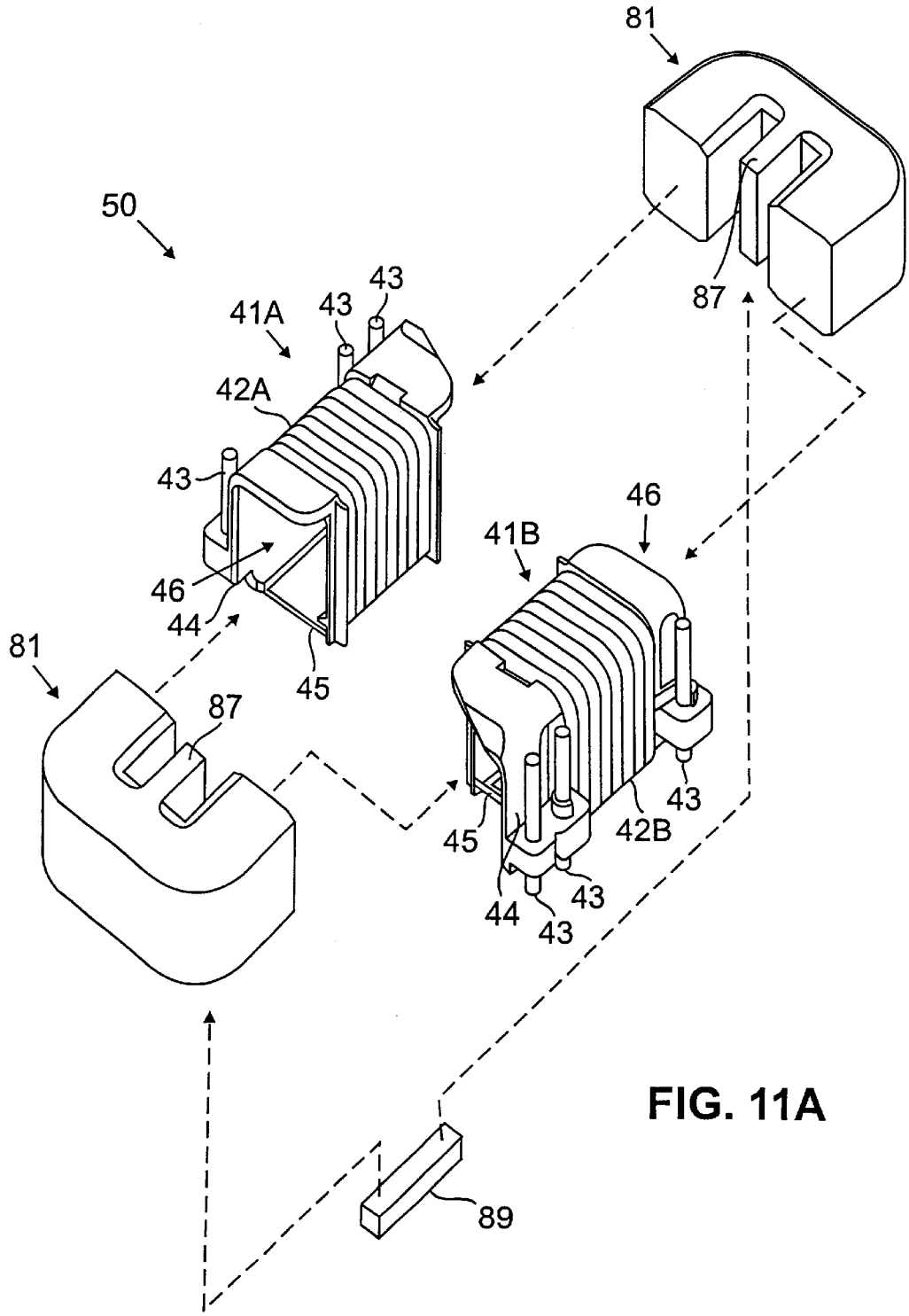
FIGS. 11A through 11C show transformers using saturable slugs.
Figure 11B:
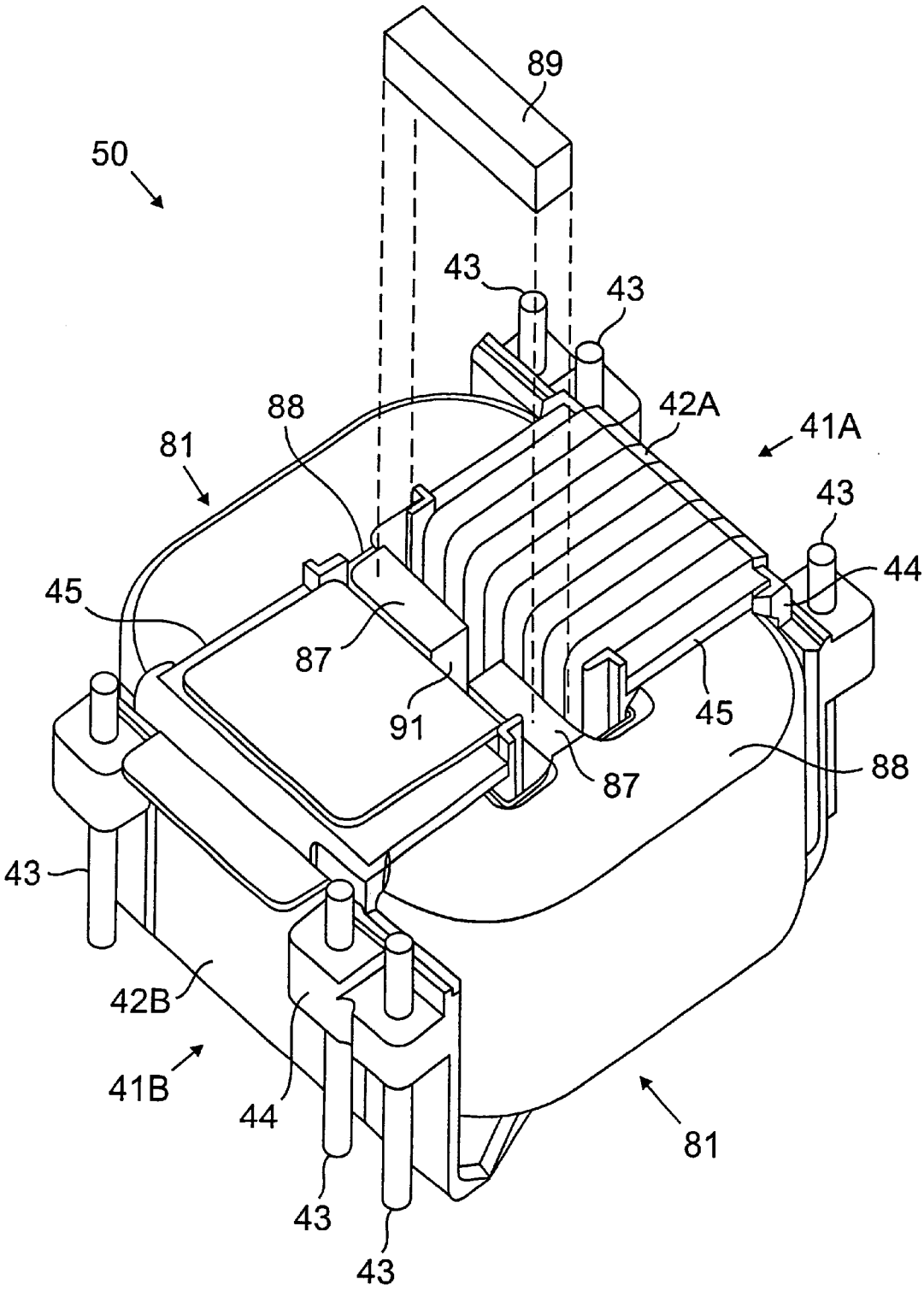

Another transformer 50 is shown in FIGS. 11A and 11B. All of the elements in the Figures are the same as those shown in FIG. 5, except that a winding 42B is shown installed on composite bobbin 41B (a multi-turn winding in 4 FIG. 11A and a single turn winding in FIG. 11B); the core assemblies 81 are modified to include magnetically permeable "leakage lugs" 87; and a piece of saturable magnetic material (a "saturable slug" 89) is shown for use in bridging the region of the leakage gap 91 (FIG. 11B) formed between the leakage lugs 87. The slug may be attached by an adhesive or epoxy or it may be held in place mechanically (e.g., by a clip). The leakage lugs perform the same function as those shown in FIG. 2 and disclosed in the transformer patent: by providing a path for flux which does not couple both windings, the lugs increase the equivalent leakage inductance of the transformer 50 over that which would be present in a transformer without the lugs. A conductive medium, of the kind described above and in the transformer patent, for constraining the emanation of leakage flux, may also be present on the surfaces of the core assemblies 81 (including the surfaces of the leakage lugs 87), with appropriate provisions being made to avoid formation of shorted turns around the flux paths. In FIG. 11B, a conductive medium 88 is shown covering the surfaces of the ends of the core assemblies 81 (but not the leakage lugs 87).

Figure 3:
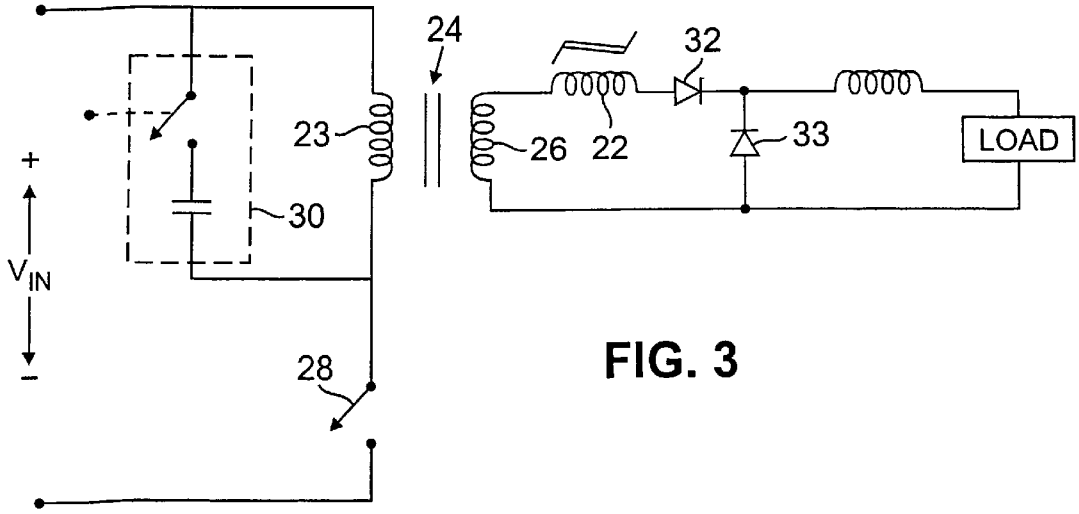
FIG. 3 shows a partial schematic view of a switching power supply.

The saturable slug 89 has a relatively high magnetic permeability up to a flux level corresponding to its saturation flux density. Above the saturation flux density the slug saturates and the equivalent permeability drops sharply. Thus, when a voltage is applied to the transformer, the saturable slug will initially appear as a low permeability path and will shunt substantial flux. This will be reflected as a relatively high equivalent value of leakage inductance. When the flux density in the slug rises to the saturation flux density the slug will no longer be effective as a path for incremental flux and the incremental reluctance of the magnetic path comprising the slug 89 and the lugs 87 will be essentially equal to the incremental reluctance of the lugs 87 and the leakage gap 91 alone. Thus, when the slug saturates, the equivalent leakage inductance of the transformer can be made to drop to a lower level (approximately equal to the leakage inductance of the transformer 50 without the slug 89). As a result, the slug can produce an effect which is similar to that of the discrete saturable inductor 22 shown in FIG. 3. However, while different discrete saturable inductors 22 having differing numbers of turns are required to provide the same "time to saturation" rating for transformer configurations having the same magnetic cores but different turns ratios, this is not the case when a saturable slug is used. If, for example, a family of transformers is designed for optimum core utilization (e.g., an essentially fixed "volts per turn" rating is factored into the selection of the windings so that an essentially constant peak flux density is achieved in each different transformer), then the flux in the path comprising the slug 89 and the lugs 87 will be approximately the same independent of the input voltage and turns ratio of the transformer. As a result, a given combination of core 81, saturable slug 89 and leakage gap 91 will produce saturable inductances having essentially the same "time to saturation"

ratings irrespective of the turns ratio of the transformer, provided only that the volts-per-turn of the windings in different configurations are maintained approximately the same. Thus, a single configuration of core assemblies and slug can provide a wide variety of transformers, all of which will exhibit essentially the same "time to saturation." For a given size core and core material, and a given core plating pattern, the leakage inductance of the transformer before and after saturation can be set by varying the gap and the dimensions of the saturable slug.

Figure 1A:
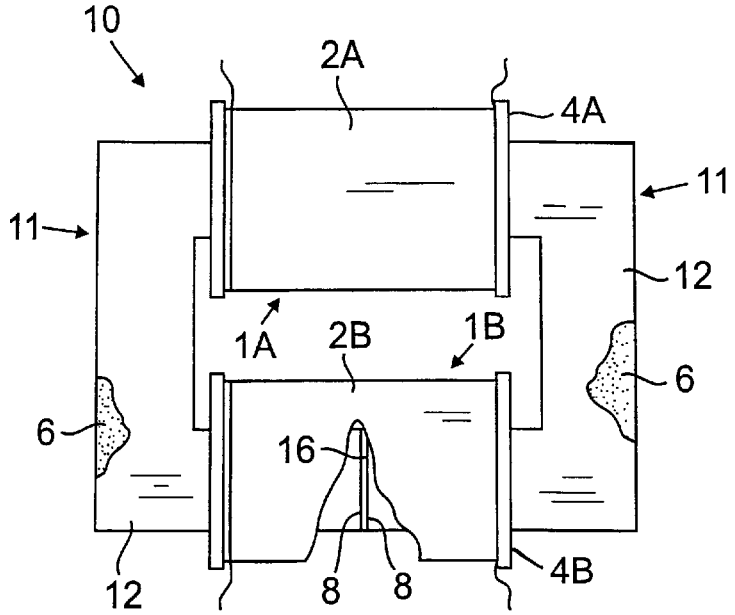
FIGS. 1A and 1B show, respectively, top and side views of a transformer.
Figure 1B:
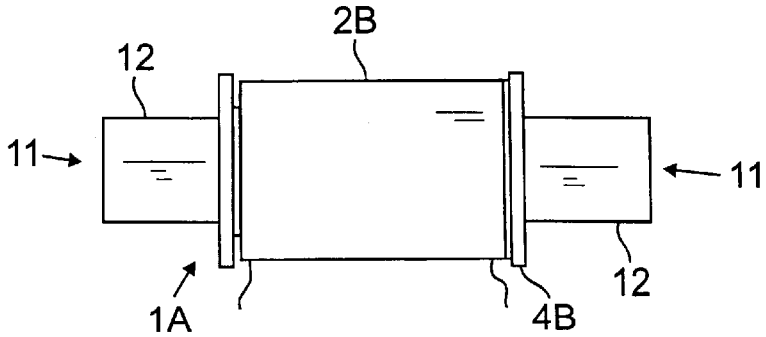

Transformers using leakage lugs (with or without slugs) are useful in applications in which a pre-determined and controlled amount of transformer leakage inductance is required (e.g., in zero-current switching power converters of the kind described in U.S. Pat. No. 4,441,146, "Optimal Resetting of the Transformer's Core in Single-Ended Forward Converter", Vinciarelli, assigned to the same assignee as this application, incorporated by reference). In certain applications, however, such as PWM power converters, it is desirable to minimize transformer leakage inductance. In such converters, a transformer might incorporate a conductive medium (e.g., medium 12, FIG. 1) over a substantial portion of the surface of the core pieces (as this will reduce leakage inductance) and leakage lugs would not be used (as their use would increase leakage inductance). The benefit of a saturable slug may be achieved in such a transformer by installing the slug between regions on the surfaces of the permeable cores which have been cleared of conductive medium. One example of such a transformer is shown in FIG. 1C. In the Figure, a saturable slug 89 is attached to the surface of the permeable cores at locations 99 which have been cleared of conductive medium 12. Another way of incorporating the slug 89 is to clear the conductive medium 12 from the inner faces 100 of the ends of the core pieces and install the slug between the cleared locations on the faces.

Transformers using saturable slugs may be constructed using the methods described above: a gap 56 between the core pieces can be set as a means of providing a desired value of magnetizing inductance and the composite bobbins may then be bonded to the core pieces to maintain the gap. A saturable slug may then be added to the transformer to provide the desired "time to saturation" characteristic.

Non-saturating material may also be used for the slug 89, to provide an essentially constant value of leakage inductance. This is useful where a range of values of leakage inductance need to be set.

Figure 11C:
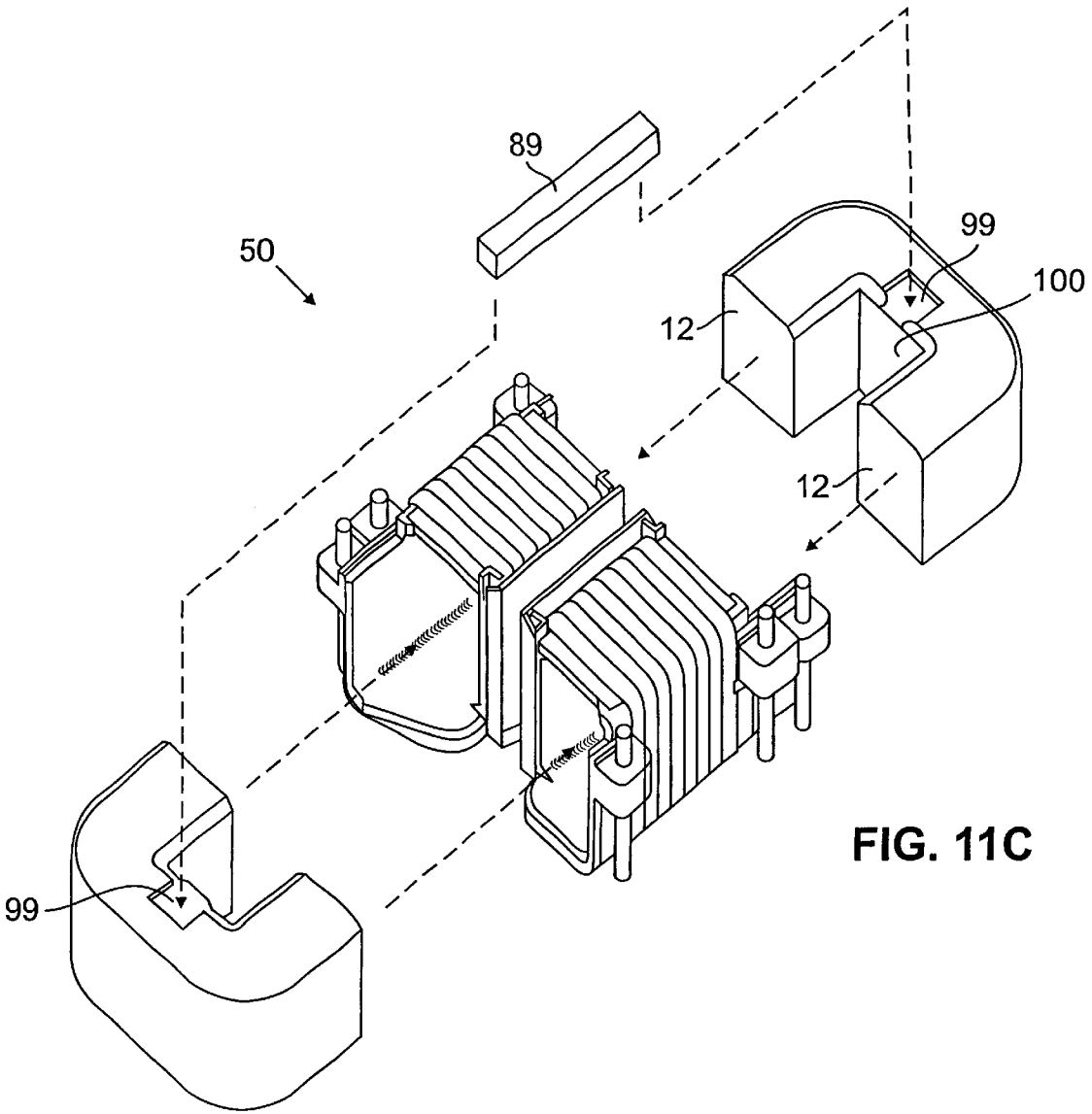
Figure 11D:
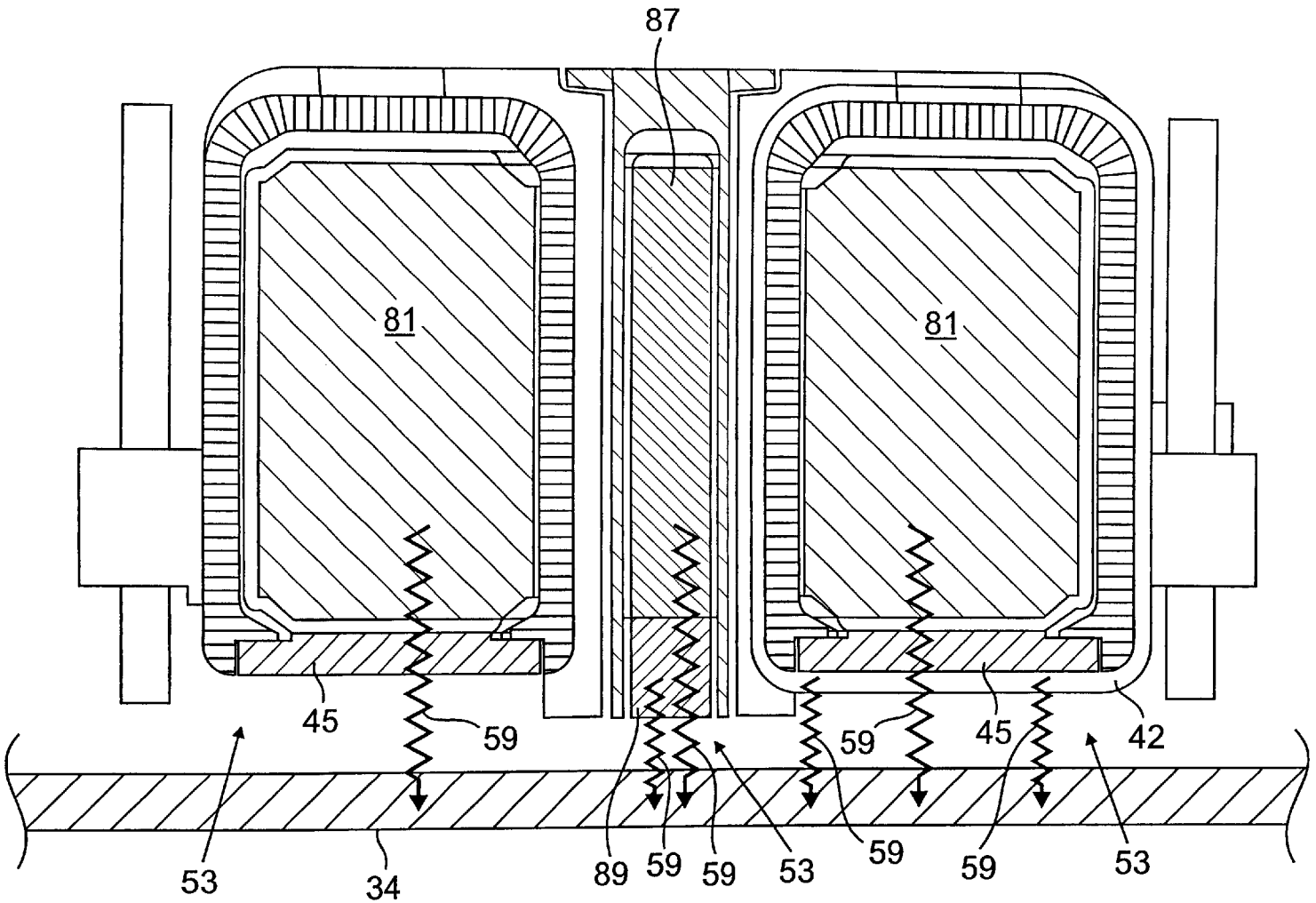
FIG. 11D shows a transformer with a saturable slug in proximity to a heat sinking surface.

The slug is easy to cool owing to its location on the outer surface of the transformer 50. As shown in FIG. 11D, by locating the slug 89 on the side of the transformer on which the conductive segments 45 are located, and placing the transformer in proximity to a heat sinking surface 34 (as shown, for example, in FIG. 8) with thermally conductive material (such as a silicone encapsulant) in the regions 53 between the transformer and the heat sink 34, heat from the saturable slug 89 can flow directly down into the heat sink. Transformers of the kind shown in FIGS. 11A through 11C are thermally optimal in an application like that shown in FIG. 11D because low thermal impedance paths 59 (FIG. 11D) exist between the heat sink 34 and the core assemblies 81; the heat sink and the windings (one winding 42 is shown in FIG. 11D); the heat sink and the saturable slug 89; and the heat sink and the leakage lugs 87.

Figure 12A:
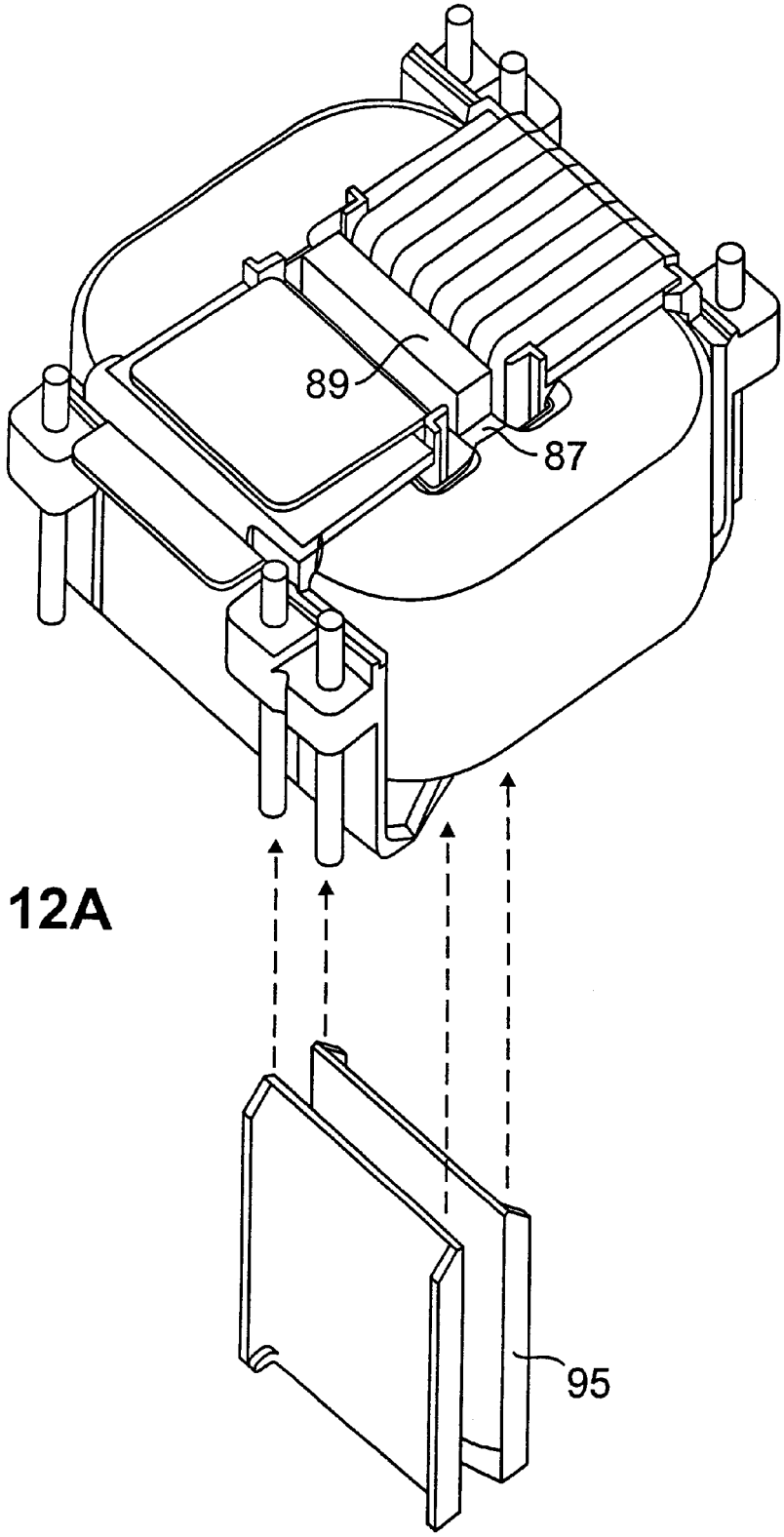
FIGS. 12A and 12B show a transformer with an insulating coupler.
Figure 12B:
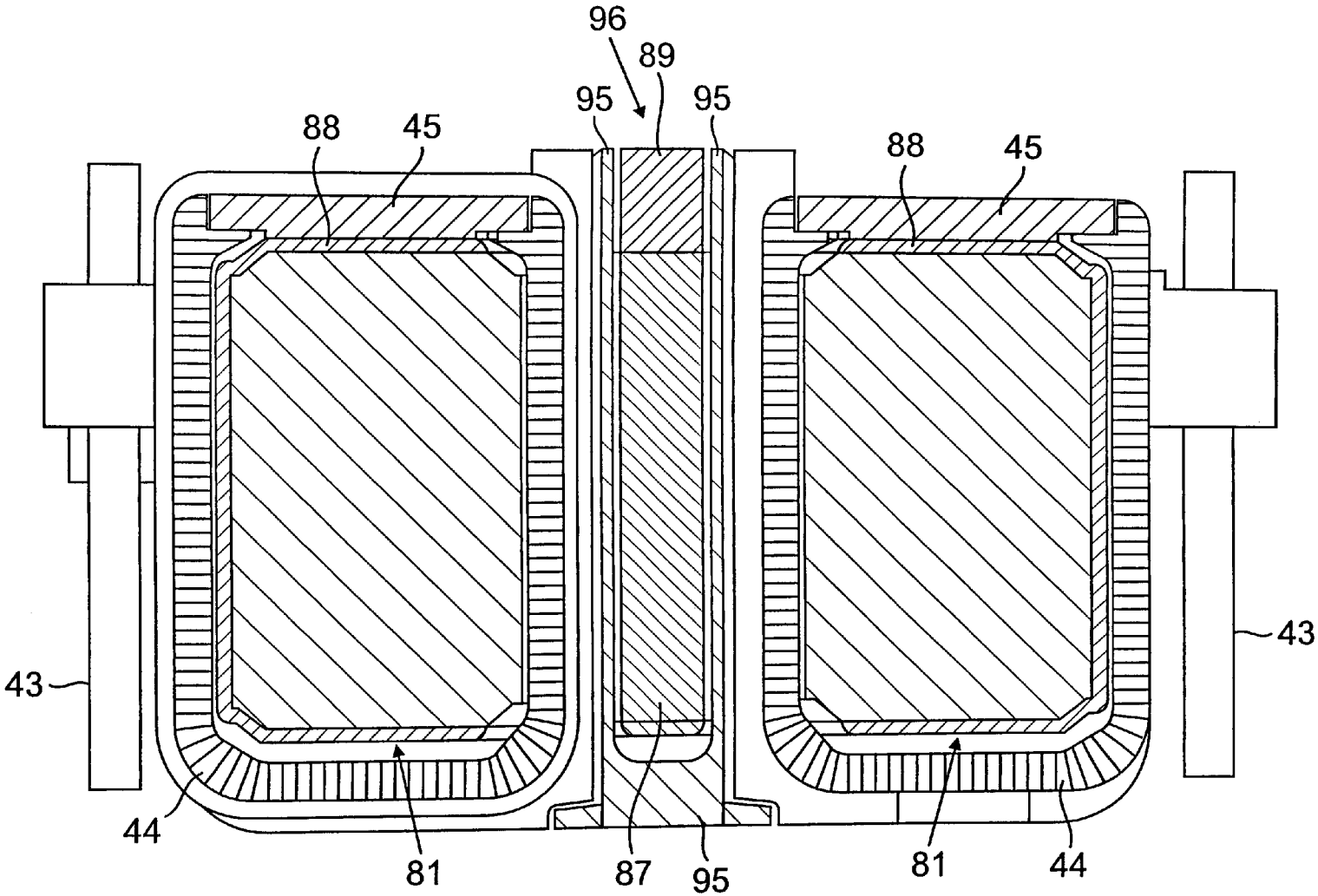

In some applications the presence of the leakage lugs 87 and the slug 89 in the region between the windings 42A, 42B may reduce the interwinding breakdown voltage rating. As shown in FIGS. 12A and 12B (which shows a section through the transformer in the region of the two bobbins), a U-shaped electrically insulating coupler 95 can be used to provide additional insulation. The coupler 95 fits over the leakage lugs 87 to provide additional interwinding insulation but leaves the slug 89 exposed in the region 96 at the bottom to allow for removal of heat as explained above.

Other embodiments fall within the scope of the following claims. For example, the high thermal conductivity material may be aluminum nitride, boron nitride, silicon carbide, silicon nitride, beryllium oxide or zirconia. The low thermal conductivity segment of the bobbin may be fabricated from a thermal plastic (e.g., phenolic, bakelite) or a thermoplastic.

What is claimed is:

1. An apparatus comprising a bobbin, the bobbin comprising a wall including an electrically insulating material surrounding an interior space for receiving a portion of a permeable core, the wall having an interior surface forming a perimeter around the interior space, an external surface for supporting a winding, a first segment with a first thermal conductivity, and a second segment with a second thermal conductivity, the second thermal conductivity being lower than the first thermal conductivity, the wall separating the winding from the portion of the permeable core, and the first segment providing a thermally conductive path for conduction of heat from the core to a location outside the winding.

2. The apparatus of claim 1 wherein the first segment comprises ceramic.

3. The apparatus of claim 1 wherein one of said segments comprises plastic.

4. The apparatus of claim 2 wherein the ceramic comprises alumina.

5. The apparatus of claim 1 wherein the first segment comprises a portion of the interior surface for attachment to the permeable core.

6. The apparatus of claim 5 wherein said portion of the internal surface is solderable.

7. The apparatus of claim 5 wherein said portion of the internal surface comprises a metal coating.

8. The apparatus of claim 1 wherein one of said segments comprises an insulator with a conductive coating deposited on it.

9. The apparatus of claim 1 wherein one of said segments comprises a material having a thermal conductivity greater than 1 BTU/(hourxfootxdeg.F)).

10. The apparatus of claim 1 wherein one of said segments comprises a material having a thermal conductivity less than 1 BTU/(hourxfootxdeg.F)).

11. The apparatus of claim 1 further comprising the permeable core wherein the portion of the permeable core is located within said interior space.

12. The apparatus of claim 11 wherein said permeable core comprises separable core pieces which define a magnetic path.

13. The apparatus of claim 12 Wherein the ends of said core pieces are separated by a gap.

14. The apparatus of claim 11 wherein said permeable core comprises a conductive medium on a portion of its surface.

15. The apparatus of claim 12 or 13 wherein said permeable core pieces comprise a conductive medium on portions of their surfaces.

16. The apparatus of claim 12 or 13 wherein one of said segments is attached to said core pieces.

17. The apparatus of claim 15 wherein one of said segments is attached to said core pieces.

18. The apparatus of claim 16 wherein said attached segment maintains the ends of said core pieces in a fixed relation to each other and maintains a gap between the ends.

19. The apparatus of claim 17 wherein said attached segment maintains the ends of said core pieces in a fixed relation to each other and maintains a gap between the ends.

20. The apparatus of claim 16 wherein said attached segment comprises the first segment and the first segment has a thermal conductivity greater than 1 BTU/(hourxfootxdeg.F)).

21. The apparatus of claim 17 wherein said attached segment comprises the first segment and the first segment has a thermal conductivity greater than 1 BTU/(hourxfootxdeg.F)).

22. The apparatus of claim 18 wherein said attached segment comprises the first segment and the first segment has a thermal conductivity greater than 1 BTU/(hourxfootxdeg.F)).

23. The apparatus of claim 16 wherein a surface of said attached segment comprises a metal layer.

24. The apparatus of claim 17 wherein a surface of said attached segment comprises a metal layer.

25. The apparatus of claim 18 wherein a surface of said attached segment comprises a metal layer.

26. The apparatus of claim 16 wherein said attached segment is attached to the core by epoxy.

27. The apparatus of claim 17 wherein said attached segment is attached to the core by epoxy.

28. The apparatus of claim 18 wherein said attached segment is attached to the core by epoxy.

29. The apparatus of claim 17 wherein said segment is attached to said conductive medium by solder.

30. The apparatus of claim 16 wherein said attached segment comprises the first segment and the first segment comprises ceramic.

31. The apparatus of claim 17 wherein said attached segment comprises the first segment and the first segment comprises ceramic.

32. The apparatus of claim 18 wherein said attached segment comprises the first segment and the first segment comprises ceramic.

33. The apparatus of claim 26 wherein said metal layer comprises copper.

34. The apparatus of claim 1 further comprising:

a winding on said external surface, and a permeable magnetic core, wherein the portion of the permeable core is located within said interior space.

35. The apparatus of claim 34 wherein said magnetic core comprises separable core pieces.

36. The apparatus of claim 35 wherein the ends of said separable core pieces are separated by a gap that lies within the bobbin.

37. The apparatus of claim 34 wherein said permeable core comprises a conductive medium on a portion of its surface.

38. The apparatus of claim 35 or 36 wherein said separable core pieces comprise a conductive medium on portions of their surfaces.

39. The apparatus of claim 34 wherein one of the segments is attached to said permeable core.

40. The apparatus of claim 35 or 36 wherein one of the segments is attached to said core pieces.

41. The apparatus of claim 37 wherein one of the segments is attached to said permeable core.

42. The apparatus of claim 38 wherein one of the segments is attached to said core pieces.

43. The apparatus of claim 40 wherein said attachment maintains the ends of said core pieces in a fixed relation to each other and maintains a gap between the ends.

44. The apparatus of claim 42 wherein said attachment maintains the ends of said core pieces in a fixed relation to each other and maintains a gap between the ends.

45. The apparatus of claims 39 or 41 wherein said attached segment comprises the first segment and the first segment has a thermal conductivity greater than 1 BTU/(hourxfootxdeg.F)).

46. The apparatus of claim 40 wherein said attached segment comprises the first segment and the first segment has a thermal conductivity greater than 1 BTU/(hourxfootxdeg.F)).

47. The apparatus of claims 43 wherein said attached segment comprises the first segment and the first segment has a thermal conductivity greater than 1 BTU/(hourxfootxdeg.F)).

48. The apparatus of claims 39 or 41 wherein a surface of said attached segment comprises a metallic layer.

49. The apparatus of claim 40 wherein a surface of said attached segment comprises a metallic layers.

50. The apparatus of claim 42 wherein a surface of said attached segment comprises a metallic layer.

51. The apparatus of claim 39 or 41 wherein said attached segment is attached to the core by means of epoxy.

52. The apparatus of claim 40 wherein said attached segment is attached to the core by means of epoxy.

53. The apparatus of claim 42 wherein said attached segment is attached to the core by means of epoxy.

54. The apparatus of claim 41 wherein said attached segment is attached to said conductive medium by means of solder.

55. The apparatus of claim 39 or 41 wherein said attached segment comprises the first segment and the first segment comprises ceramic.

56. The apparatus of claim 40 wherein said attached segment comprises the first segment and the first segment comprises ceramic.

57. The apparatus of claim 43 wherein said attached segment comprises the first segment and the first segment comprises ceramic.

58. The apparatus of claim 48 wherein said metallic layer comprises copper.

59. The apparatus of claim 34 further comprising a magnetically permeable leakage lug which is located outside of a hollow interior space enclosed by the bobbin.

60. The apparatus of claim 27 wherein said metal layer comprises copper.

61. The apparatus of claim 28 wherein said metal layer comprises copper.

62. The apparatus of claim 48 wherein said attached segment is attached to said conductive medium by means of solder.

63. The apparatus of claim 49 wherein said metal layer comprises copper.

64. The apparatus of claim 50 wherein said metal layer comprises copper.

65. The apparatus of claim 31 wherein the second segment comprises plastic.

66. The apparatus of claim 39 wherein the second segment comprises plastic.

67. The apparatus of claim 55 wherein the second segment comprises plastic.

68. The apparatus of claim 1, 11, or 34 wherein the first segment and the second segment are arranged to alternate along the perimeter.

69. The apparatus of claim 68 wherein the first segment comprises ceramic and the second segment comprises plastic.

70. The apparatus of claim 69 wherein the second segment forms more than half of the perimeter.

71. The apparatus of claim 1, 11 or 34 wherein the thermally conductive path passes through a portion of the winding.

72. The apparatus of claim 1, 11, or 34 wherein the path extends from the interior surface to the exterior surface and occupies only a portion of the perimeter.

73. The apparatus of claim 48 wherein said metallic layer is attached to said conductive medium by solder.

74. The apparatus of claim 50 wherein said metallic layer is attached to said conductive medium by solder.

* * * * *

UNITED STATES PATENT AND TRADEMARK OFFICE

CERTIFICATE OF CORRECTION

PATENT NO. : 6,600,402 B1
APPLICATION NO. : 09/184461
DATED : July 29, 2003
INVENTOR(S) : Michael B. LaFleur and Patrizio Vinciarelli It is certified that error appears in the above-identified patent and that said Letters Patent is hereby corrected as shown below:

Column 8, Claim 13, Line 53, "Wherein the ends of said" should be replaced with --wherein the ends of said--

Column 10, Claim 47, Line 12, "The apparatus of claims 43" should be replaced with --The apparatus of claim 42--

Column 10, Claim 49, Line 18, "comprises a metallic layers" should be replaced with --comprises a metallic layer--

Column 10, Claim 57, Line 35, " The apparatus of claim 43" should be replaced with --The apparatus of claim 42--

Column 10, Claim 62, Line 47 "The apparatus of claim 48" should be replaced with --The apparatus of claim 42--

Column 10, Claim 66, Line 56, "The apparatus of claim 39" should be replaced with --The apparatus of claim 30--

Signed and Sealed this

Twenty-first Day of August, 2007

JON W. DUDAS
*Director of the United States Patent and Trademark Office*